US008710769B2

(12) United States Patent
Muramatsu et al.

(10) Patent No.: US 8,710,769 B2
(45) Date of Patent: Apr. 29, 2014

(54) DISCHARGE LAMP LIGHTING CIRCUIT

(75) Inventors: Takao Muramatsu, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 410 days.

(21) Appl. No.: 13/224,389

(22) Filed: Sep. 2, 2011

(65) Prior Publication Data

US 2012/0056549 A1 Mar. 8, 2012

(30) Foreign Application Priority Data

Sep. 7, 2010 (JP) ..... 2010-199475
Mar. 31, 2011 (JP) ..... 2011-077384

(51) Int. Cl.
*H05B 37/02* (2006.01)

(52) U.S. Cl.
USPC ..... 315/307; 315/219; 315/308

(58) Field of Classification Search
USPC ..... 315/219, 307, 308, 224, 291, DIG. 5, 315/DIG. 7
See application file for complete search history.

(56) References Cited

U.S. PATENT DOCUMENTS 4,544,863 A * 10/1985 Hashimoto ..... 315/209 R
6,392,364 B1 * 5/2002 Yamamoto et al. ..... 315/291
6,815,908 B2 * 11/2004 Glaser et al. ..... 315/224
8,138,685 B2 * 3/2012 Yu et al. ..... 315/291
2006/0202639 A1 * 9/2006 Kato ..... 315/291

FOREIGN PATENT DOCUMENTS

JP 07-142182 6/1995

* cited by examiner

*Primary Examiner* — David H Vu
(74) *Attorney, Agent, or Firm* — Fish & Richardson P.C.

(57) ABSTRACT

A discharge lamp lighting circuit includes a DC/DC converter which generates from an input voltage a drive voltage to be applied to a discharge lamp of a driven object. A first drive voltage generating path has one end to which the input voltage is applied, and at the other end of which is an output capacitor on an output side of the DC/DC converter. A second drive voltage generating path has one end to which the input voltage is applied, and at the other end of which is the output capacitor. The second drive voltage generating path is different from the first drive voltage generating path. A control circuit controls ON/OFF of the first drive voltage generating path. The discharge lamp lighting circuit is arranged so that the voltage of the output capacitor when the first drive voltage generating path is in an ON-state becomes higher than the voltage of the output capacitor when the first drive voltage generating path is not so.

9 Claims, 8 Drawing Sheets

DISCHARGE LAMP LIGHTING CIRCUIT

CROSS-REFERENCE TO RELATED APPLICATION(S)

The present application claims the benefit of priority of Japanese Patent Application No. 2010-199475, filed on Sep. 7, 2010 and Japanese Patent Application No. 2011-077384, filed on Mar. 31, 2011. The disclosure of these applications is incorporated herein by reference.

TECHNICAL FIELD

The present disclosure relates to a discharge lamp lighting circuit.

RELATED ART

In recent years, a metal halide lamp (hereinafter, referred to as a discharge lamp) has been used as a vehicle lamp (e.g., head lamp) in place of a conventional halogen lamp having a filament. Compared with the halogen lamp, the discharge lamp can obtain higher luminance efficiency and a longer lifetime, while it requires drive voltage of tens to hundreds of volts. Therefore, the discharge lamp cannot be directly driven by a car battery of 12V or 24V, and a discharge lamp lighting circuit (referred to as a ballast) is required.

The discharge lamp lighting circuit steps up a battery voltage and supplies the stepped-up battery voltage to a discharge lamp.

For example, in Japanese Patent Document JP-A-Hei 07-142182, there is described a lighting circuit which steps up a DC (direct current) input voltage by a DC step-up circuit, converts the stepped-up voltage into a square-wave voltage by a DC-AC conversion circuit, superimposes a starting pulse generated by a starting pulse generating circuit on this square-wave voltage, and supplies the superimposed voltage to the discharge lamp.

The starting pulse generating circuit is a circuit to cause the discharge lamp start to light up by applying a high-voltage starting pulse to the discharge lamp, which includes a transformer of which a secondary coil is connected to the discharge lamp. The starting pulse generating circuit amplifies the output voltage from the DC step-up circuit and thereafter applies the amplified output voltage to a primary coil of the transformer in a pulse manner. In response, a high-voltage pulse is generated in the secondary coil of the transformer.

The operation for lighting a discharge lamp in a conventional discharge lamp lighting circuit is as follows:

(1) Before lighting, an output voltage is raised up to about 400 V, and a high-voltage pulse of 20 kV or more is applied to the discharge lamp thereby to start lighting of the discharge lamp.

(2) After lighting, the output voltage is controlled within a range of tens volts to 100V.

To secure lighting performance immediately after the discharge lamp has started lighting, it is necessary to step up the output voltage before lighting up to about 400V, which is higher than the output voltage after lighting. This voltage affects greatly lighting property of the discharge lamp.

As described above, since the output voltage, though being 100V or less after lighting, must be as high as about 400V before lighting, a withstand voltage of a DC/DC converter element is selected so that the element is maintained even if the output voltage comes to 400V or more. Therefore, considering only the withstand voltage after lighting, the withstand voltage of the element has exaggerated specifications, which hampers improvement in electric efficiency of the circuit.

SUMMARY

Some embodiments of the present invention provide a discharge lamp lighting circuit capable of improving electric efficiency.

For example, according to one aspect, a discharge lamp lighting circuit can include a DC/DC converter which generates from an input voltage a drive voltage to be applied to a discharge lamp of a driven object. A first drive voltage generating path has one end to which the input voltage is applied, and at the other end an output capacitor is provided on an output side of the DC/DC converter. A second drive voltage generating path has one end to which the input voltage is applied, and at the other end is the output capacitor. The second drive voltage generating circuit is different from the first drive voltage generating path. A control circuit controls ON/OFF of the first drive voltage generating path. The discharge lamp lighting circuit is constituted so that, when the first drive voltage generating path is in an ON-state, the voltage of the output capacitor becomes higher than the voltage of the output capacitor if the first drive voltage generating path is not so.

According to some implementations, the control circuit causes the first drive voltage generating path to be in an ON-state if the high voltage of the output capacitor is required, and the control circuit causes the first drive voltage generating path to be in an OFF-state if the high voltage of the output capacitor is not required. Therefore, the element of the second drive voltage generating path can be selected based on the low voltage of the output capacitor.

The disclosure also describes methods and systems based on the foregoing implementations.

According to the exemplary embodiment of the present invention, it is possible to improve the electric efficiency of the discharge lamp lighting circuit. Other aspects, features and advantages will be readily apparent from the following detailed description, the accompanying drawings and the claims.

DETAILED DESCRIPTION

Examples of the invention are described below with reference to drawings.

In the specification, "a state in which a member A is connected to a member B" includes the case in which the members A and B are connected physically and directly, as well as the case in which the members A and B are connected indirectly through another member which does not affect an electrical connecting state. Similarly, "a state in which a member C is provided between the members A and B" includes the case in which the members A and C or the members B and C are directly connected to each other," as well as the case in which they are connected indirectly through another member which does not affect an electrical connecting state.

First Embodiment

Figure 1:
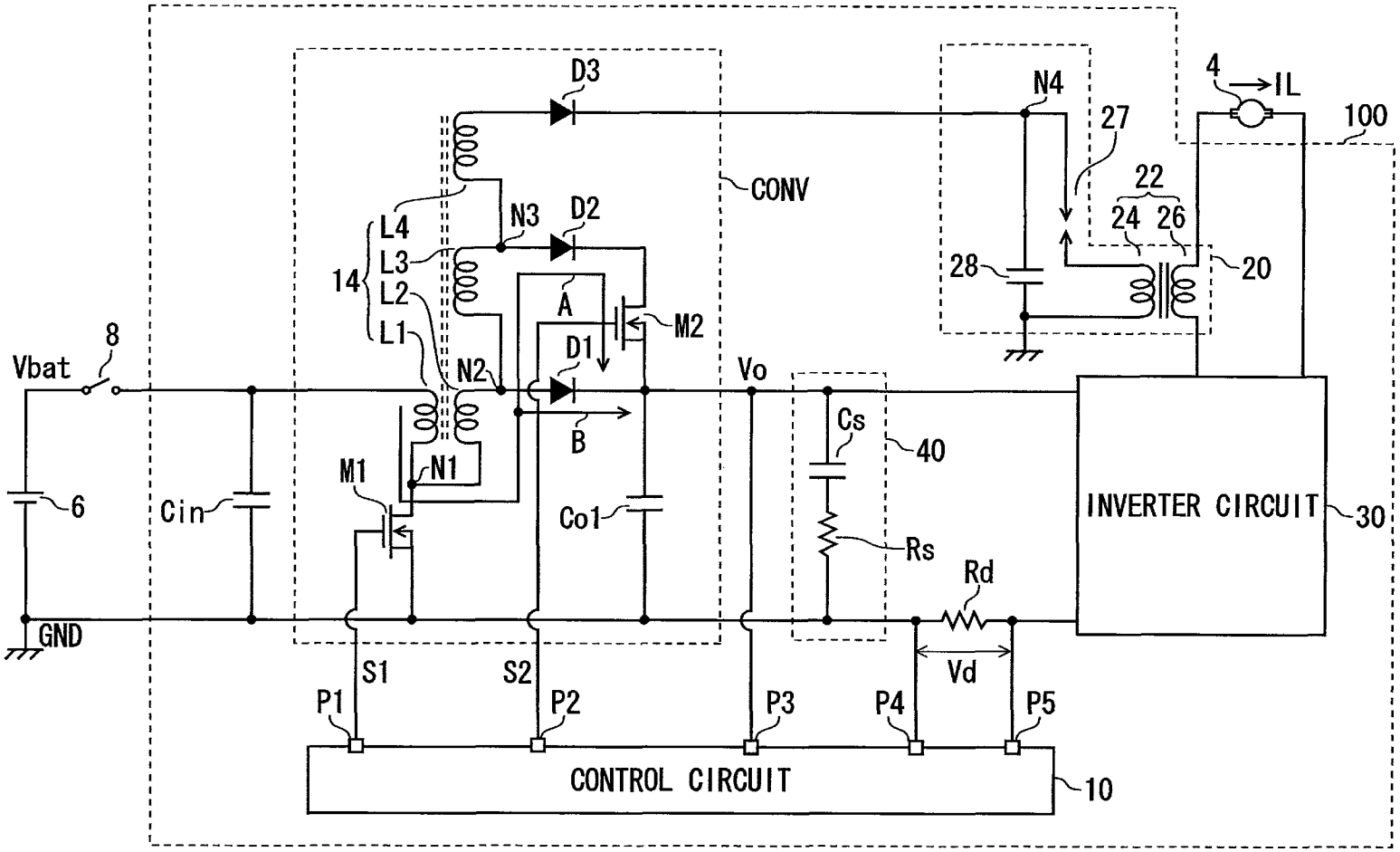
FIG. 1 is a circuit diagram showing the configuration of a discharge lamp lighting circuit according to a first embodiment.

FIG. 1 is a circuit diagram showing the configuration of a discharge lamp lighting circuit 100 according to a first embodiment. The discharge lamp lighting circuit 100 drives a discharge lamp 4 which is a metal halide lamp for vehicle. The discharge lamp lighting circuit 100 and the discharge lamp 4 are mounted on a vehicle lamp. The discharge lamp lighting circuit 100 is connected to a car battery (hereinafter, simply referred to as a battery) 6 and a power switch 8.

The battery 6 generates a DC (direct current) battery voltage (power voltage) Vbat of 12V (or 24V). The power switch 8 is a relay switch provided to control ON/Off operations of the discharge lamp 4, and is in series with the battery 6. When the power switch 8 is turned on, the battery voltage Vbat is supplied from the battery 6 to the discharge lamp lighting circuit 100.

The discharge lamp lighting circuit 100 steps up the smoothed battery voltage Vbat, carries out AC conversion, and supplies a voltage thus obtained to the discharge lamp 4. The discharge lamp lighting circuit 100 includes a DC/DC converter CONY, a control circuit 10, a starter circuit 20, an inverter circuit 30, an auxiliary lighting circuit 40, an input capacitor Cin, and a current detecting resistor Rd.

The input capacitor Cin is provided in parallel with the battery 6, and smoothes the battery voltage Vbat. More specifically, the input capacitor Cin is provided in the vicinity of a first input transformer 14, and fulfills a function of smoothing the voltage with respect to a switching operation of the DC/DC converter CONV.

The DC/DC converter CONY steps up the battery voltage Vbat. The DC/DC converter CONY is a non-insulation type switching regulator, and includes the first input transformer 14, a first output diode D1, a second output diode D2, a third output diode D3, a first switching element M1, a second switching element M2, and a first output capacitor Co1.

The first input transformer 14 has a first coil L1, a second coil L2, a third coil L3, and a fourth coil L4. The first coil L1, the second coil L2, the third coil Ld, and the fourth coil L4 are in series and are connected to one another in the recited order. If the power switch 8 is turned on, an input voltage to the discharge lamp lighting circuit 100, that is, the battery voltage Vbat is applied to one end of the first coil L1.

The first switching element M1 provides electrical conduction between the other end of the first coil L1 and a ground terminal (GND). The first switching element M1 is composed of, for example, an N-channel MOSFET (Metal Oxide Semiconductor Field Effect Transistor). A drain of the first switching element M1 is connected to a first node N1 on a path connecting the other end of the first coil L1 and one end of the second coil L2. A source of the first switching element M1 is grounded.

A control terminal (gate) of the first switching element M1 is connected to a first terminal P1 of the control circuit 10. A control pulse signal S1, which has a first drive frequency f1 and has been subjected to pulse-width modulation, is applied to the control terminal of the first switching element M1. For example, in a stationary lighting state, the first drive frequency f1 is 400 kHz. The first switching element M1 is turned on when the control pulse signal S1 has a high level, and is turned off when the control pulse signal S1 has a low level.

The winding direction of each coil in the first input transformer 14 is set so that the voltage becomes higher in order of the first node N1, a second node N2 on a path connecting the other end of the second coil L2 and one end of the third coil L3, a third node N3 on a path connecting the other end of the third coil L3 and one end of the fourth coil L4, and the other end of the fourth coil L4 if the first switching element M1 has been subjected to pulse-width modulation drive by the control circuit 10.

The first output diode D1 is provided between the second connection node N2 and one end of the first output capacitor Co1. An anode of the first output diode D1 is connected to the second connection node N2, and a cathode thereof is connected to one end of the first output capacitor Co1. The other end of the first output capacitor Co1 is grounded.

The second output diode D2 and the second switching element M2 are connected in series with each other and constitute a series circuit. The second switching element M2 is composed of, for example, an N-channel MOSFET. In this series circuit, a drain of the second switching element M2 is connected to a cathode of the second output diode D2. This series circuit is provided, between the third connection node N3 and one end of the first output capacitor Co1, in parallel with the first output diode D1. Namely, an anode of the second output diode D2 is connected to the connection node N3, and a source of the second switching element M2 is connected to one end of the first output capacitor Co1.

A control terminal (gate) of the second switching element M2 is connected to a second terminal P2 of the control circuit 10. A path switching signal S2 is applied to the control terminal of the second switching element M2. The second switching element M2 is turned on when the path switching signal S2 has a high level, and is turned off when the path switching signal S2 has a low level. The path switching signal S2 is described below in greater detail.

An anode of the third output diode D3 is connected to the other end of the fourth coil L4. A cathode of the third output diode D3 is connected to the starter circuit 20.

The auxiliary lighting circuit 40 has an auxiliary lighting capacitor Cs and an auxiliary lighting resistor Rs which are connected in series with each other between one end of the first output capacitor Co1 and the ground terminal. The auxiliary lighting capacitor Cs and the auxiliary lighting resistor Rs are provided in order to cause the discharge lamp 4 to carry out an arc growth.

The inverter circuit 30 converts a DC output voltage Vo generated by the DC/DC converter CONV into an AC voltage having a lighting frequency fo and supplies the converted voltage to the discharge lamp 4. A known inverter circuit such as an H bridge circuit can be used as the inverter circuit 30.

The lighting frequency fo is set lower than the first drive frequency f1. The lighting frequency fo is set to 10 kHz or less, and preferably about 250 Hz to 750 Hz. In the illustrated example, the lighting frequency fo is set to 312.5 Hz.

The current detecting resistor Rd is provided on a path of a lamp current IL flowing to the discharge lamp 4. In the circuit of FIG. 1, the current detecting resistor Rd is provided on a ground wiring, which connects the DC/DC converter CONV and the inverter circuit 30. In the current detecting resistor Rd, a voltage drop Vd proportional to the lamp current IL is produced.

The starter circuit 20 generates a high-voltage pulse in order to cause breakdown in the discharge lamp 4 and applies the high-voltage pulse to one end of the discharge lamp 4. The starter circuit 20 includes a high-voltage transformer 22, a spark gap 27 and a starter capacitor 28.

A secondary winding 26 of the high-voltage transformer 22 is connected to one end of the discharge lamp 4. A primary winding 24 of the high-voltage transformer 22 has one end which is grounded and the other end connected to one end of the spark gap 27. The spark gap 27 is a known discharge gap-type switch constructed so as to conduct when an insulation breakdown voltage of, for example, 800V is applied between both ends thereof. The starter capacitor 28 has one end which is grounded and the other end connected to the other end of the spark gap 27. A fourth node N4 on a path connecting the other end of the starter capacitor 28 and the other end of the spark gap 27 is connected to the cathode to the third output diode D3.

When the first switching element M1 is subjected to the pulse-width modulation drive, the starter capacitor 28 is charged through the first input transformer 14 and the third output diode D3. When the voltage of the starter capacitor 28 exceeds the insulation breakdown voltage, the spark gap 27 conducts and a pulse current flows into the primary winding 24. The high-voltage pulse generated in the secondary winding 26 in response to this pulse current is applied to one end of the discharge lamp 4.

The control circuit 10 includes a functional IC (Integrated Circuit) that controls the whole of the discharge lamp lighting circuit 100, controls an operation sequence of the discharge lamp lighting circuit 100, and regulates electric power to be supplied to the discharge lamp 4. The control circuit 10 includes the first terminal P1, the second terminal P2, a third terminal P3 to which the output voltage Vo of the DC/DC converter CONV is applied, a fourth terminal P4 connected to one end of the current detecting resistor Rd, and a fifth terminal P5 connected to the other end of the current detecting resistor Rd.

The control circuit 10 sends the pulse-width modulated control pulse signal S1 to the first switching element M1 through the first terminal P1. The control circuit 10, while monitoring the output voltage Vo and the lamp current IL, controls a duty ratio of the control pulse signal S1 so that the power to be supplied to the discharge lamp 4 approximates the desired target power. The control circuit 10 obtains information of the lamp current IL on the basis of the voltage drop Vd obtained from potential difference between the fourth terminal P4 and the fifth terminal P5.

Considering a voltage stepping-up path, the discharge lamp lighting circuit 100 includes a first drive voltage generating path A having one end to which the battery voltage Vbat is applied and the other end at the first output capacitor Co1. The lighting circuit 100 also includes a second drive voltage generating path B having one end to which the battery voltage Vbat is applied and the other end at the first output capacitor Co1. The second drive voltage generating path B is different from the first drive voltage generating path A. The first drive voltage generating path A includes the first coil L1, the second coil L2, the third coil L3, the second output diode D2, the second switching element M2, and the first output capacitor Co1. The second drive voltage generating path B includes the first coil L1, the second coil L2, the first output diode D1, and the first output capacitor Co1.

The control circuit 10 turns on (off) the second switching element M2 by setting the path switching signal S2 to a high level (low level), and correspondingly puts the first drive voltage generating path A in an ON (OFF)-state. If the first switching element M1 is subjected to the pulse width modulation drive by the control circuit 10, the voltage of the third connection node N3 becomes higher than the voltage of the second connection node N2. Accordingly, the discharge lamp lighting circuit 100 is constructed so that, when the first drive voltage generating path A is put in the ON-state, the output voltage Vo becomes higher than the output voltage Vo if the first drive voltage generating path A is not so. In particular, a circuit constant, a withstand voltage of the element and the ratio of the number of turns between the coils are selected so that, when the first drive voltage generating path A is put in the ON-state, a maximum value of the output voltage Vo becomes about 400V, and when the first drive voltage generating path A is put in the OFF-state and only the second drive voltage generating path B is put in the ON-state, a maximum value of the output voltage Vo becomes about 200V.

If the output voltage Vo is lower than a predetermined first threshold voltage V1, the control circuit 10 concludes that the discharge lamp 4 is lighting up. When the discharge lamp 4 lights up, the control circuit 10 puts the first drive voltage generating path A in the OFF-state. More specifically, when the output voltage Vo becomes lower than the first threshold voltage V1, the control circuit 10 sets the path switching signal S2 to the low level. The first threshold voltage V1 defines the maximum value of the output voltage Vo in case that the first drive voltage generating path A is put in the OFF-state and only the second drive voltage generating path B is put in the ON-state, and is set, for example, to 200V.

Figure 2:
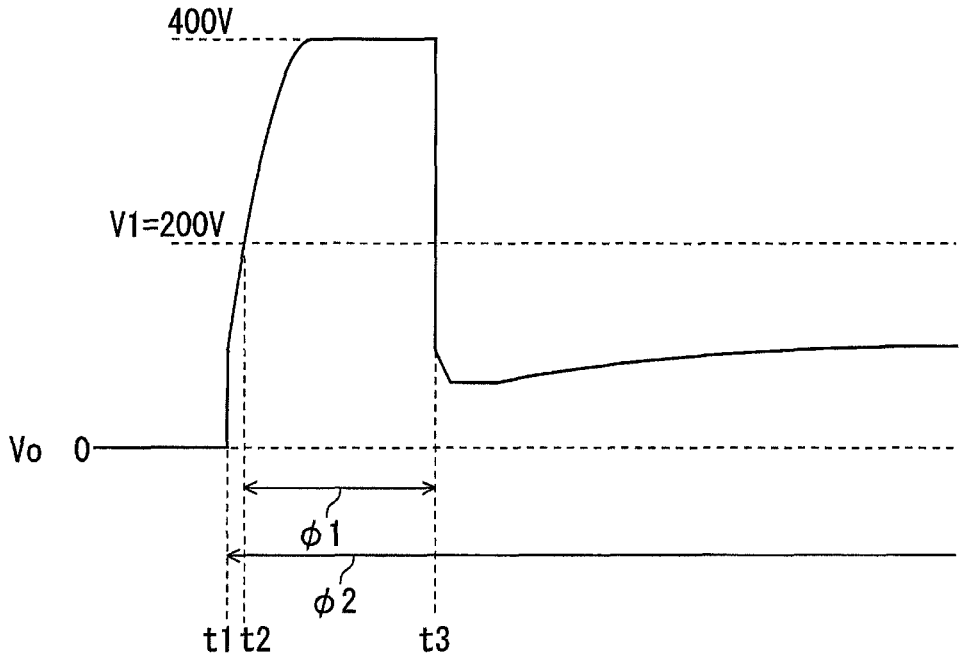
FIG. 2 is a time chart showing a time change of the output voltage.

Next, operation of the discharge lamp lighting circuit 100 is described. FIG. 2 is a time chart showing a time change of the output voltage Vo. The ordinate axis and the abscissa axis in FIG. 2 are enlarged (or reduced) to facilitate understanding, and each waveform illustrated therein is also simplified to facilitate understanding.

At time t1, when a user turns on the power switch 8, the discharge lamp lighting circuit 100 is activated. The control circuit 10 generates a control pulse signal S1 and supplies the signal S1 to the first switching element M1, thereby to activate the DC/DC convertor CONY. Then, electric charge is stored in the first output capacitor Co1 and together the output voltage Vo increases. During a period from time t1 to time t2 when the output voltage Vo comes to the first threshold voltage V1, Vo is smaller than V1. Therefore, the control circuit 10 sets a path switching signal S2 to a low level, and puts the first drive voltage generating path A in the OFF-state.

At time t2, the control circuit 10 sets the path switching signal S2 to a high level, and puts the first drive voltage generating path A in the ON-state. Then, a higher voltage is supplied from the first drive voltage generating path A to the first output capacitor Co1, and the output voltage Vo increases more. When the output voltage Vo reaches about 400V, which is the maximum value when the first drive voltage generating path A is put in the ON-state, it is stabilized. With this increase of the output voltage Vo, the first output capacitor Co1 and the auxiliary lighting capacitor Cs are also charged.

At time t3, a high-voltage pulse is applied to the discharge lamp 4 by the starter circuit 20. In result, electric breakdown occurs in the discharge lamp 4, and glow discharge is started. Namely, the discharge lamp 4 starts lighting up. When the discharge lamp 4 starts lighting up, the output voltage Vo is stabilized at the voltage which is lower than the first threshold voltage V1. This low voltage is within a range of 40V to 80V. Accordingly, at time 3, the control circuit 10 switches the path switching signal S2 to the low level and puts the first drive voltage generating path A in the ON-state.

When the electric breakdown occurs in the discharge lamp 4, a large current of several amperes is supplied, in order to prevent a lighting failure from occurring in the discharge lamp 4, to the discharge lamp 4 from the first output capacitor Co1 and the auxiliary lighting capacitor Cs which have been charged before lighting.

The first drive voltage generating path A is put in the ON-state during a period 1 from time t2 to time t3, and the second drive voltage generating path B is put in the ON-state during the entire period ϕ2 from time t1. However, during the period ϕ1, since the first drive voltage generating path A is put in the ON-state and the high voltage is supplied from this path A to the first output capacitor Co1, the second drive voltage generating path B does not contribute substantially to charging for the first output capacitor Co1.

Next, a discharge lamp lighting circuit in a comparative example is described. In this case, the components of the first drive voltage generating path A (that is, the third coil L3, the second output diode D2, and the second switching element M2) are removed from the discharge lamp lighting circuit 100 according to this embodiment, and the second drive voltage generating path B is used from before-lighting to after-lighting to generate the output voltage Vo.

In the discharge lamp lighting circuit according to the comparative example, elements which affect electric efficiency in the lighting-up time of the discharge lamp 4 are mainly the first output diode D1, the first switching element M1, and the ratio of the number of turns between the first coil L1 and the second coil L2. The withstand voltages necessary for the first output diode D1 and the first switching element M1 are determined by the maximum value of the output voltage Vo and the ratio of the number of turns between the first coil L1 and the second coil L2. As the necessary withstand voltage higher, the electric efficiency of the corresponding element worsens more. Namely, regarding the first output diode D1 and the first switching element M1, a conflicting relation exists between the necessary withstand voltage and the electric efficiency.

In the discharge lamp lighting circuit according to the comparative example, all the power supply before and after lighting-up of the discharge lamp 4 is carried out through the second drive voltage generating path B. Therefore, the withstand voltage of the first switching element M1, the withstand voltage of the first output diode D1, and the ratio of the number of turns between the first coil L1 and the second coil L2 must be selected on the basis of 400V necessary before lighting-up. Considering that the output voltage Vo at the stationary lighting time is 100V or less, it should be noted in the comparative example that in order to secure safety during a short period before lighting-up, the electric efficiency in the stationary lighting period (which is most of the residual period) is sacrificed. The inventor has found room for improvement of the electric efficiency based on that fact.

Therefore, the discharge lamp lighting circuit 100 includes the first drive voltage generating path A which generates the high output voltage Vo required before lighting-up and the second drive voltage generating path B which generates the low output voltage Vo at the stationary lighting time. Further, both paths use the first output capacitor Co1 as one end in common. Regarding the second drive voltage generating path B, the withstand voltage of the first switching element M1, the withstand voltage of the first output diode D1, and the ratio of the number of turns between the first coil L1 and the second coil L2 can be selected on the basis of the lower output voltage Vo at the stationary lighting time. Accordingly, compared with the case in the comparative example in which the elements are selected on the basis of the high output voltage Vo (~400V) required before lighting-up, the electric efficiency at the stationary lighting time can be improved.

Regarding the first drive voltage generating path A, since the withstand voltage of the second output diode D2 and the like must be selected on the basis of the high output voltage Vo required before lighting-up, the electric efficiency is not very different from that in the comparative example. In the discharge lamp lighting circuit 100, the first drive voltage generating path A is put in the ON-state before lighting-up, and put in the OFF-state after lighting-up. Accordingly, since the first drive voltage generating path A is put in the ON-state during the short period of about tens to hundreds msec before lighting-up and is put in the OFF-state at the stationary lighting time, it makes only a small contribution to the whole electric efficiency.

Further, the discharge lamp lighting circuit 100 is configured so that the second drive voltage generating path B is put in the ON-state at all times, and the first drive voltage generating path A is put in the ON or OFF state as needed. Accordingly, the possibility that the power supply to the discharge lamp 4 is interrupted by switching the path is low.

Further, in the discharge lamp lighting circuit 100, the path is switched by ON/OFF of the second switching element M2. During operation of the DC/DC converter CONY, anode voltage of the second output diode D2 becomes always higher than anode voltage of the first output diode D1 in the circuit configuration. Therefore, during the ON-state of the second switching element M2, the output voltage Vo is supplied from the first drive voltage generating path A. On the other hand, during the OFF-state of the second switching element M2, since the supply from the first drive voltage generating path A is not performed, the output voltage Vo is supplied from the second drive voltage generating path B. In the example, by using this feature, the second switching element M2 is turned on during the period when the output voltage Vo is high before lighting, so as to supply the output voltage Vo from the first drive voltage generating path A, and the second switching element M2 is turned off after lighting, so as to switch to supply from the second drive voltage generating path B. Thus, it is prevented that the element exceeds the withstand voltage.

The first threshold voltage V1 of the output voltage Vo may be set to a maximum output voltage Vo within the withstand voltage of the first switching element M1 when the second switching element M2 is turned off (the discharge lamp lights up). In this case, over-withstand voltage of the first switching element M1 can be prevented.

Further, in the discharge lamp lighting circuit 100, the voltage is supplied to the starter circuit 20 by the fourth coil L4 and the third output diode D3. Compared with the case where the output voltage of the DC/DC converter is stepped up by a voltage multiplying circuit provided separately, the circuit configuration becomes simpler because auxiliary winding is simply added to the input transformer.

In the above result, compared with the conventional discharge lamp lighting circuit, the electric efficiency can be improved without sacrificing the lighting performance of the discharge lamp, so that size reduction and cost reduction of the discharge lamp lighting circuit can be realized.

Second Embodiment

In the first embodiment, the case where two paths are provided in one DV/DC converter CONY has been described.

A discharge lamp lighting circuit 200 according to a second embodiment includes two DC/DC converters CONV1 and CONV2 which use an output capacitor in common. A first drive voltage generating path A2 is formed in a first DC/DC converter CONV1, and a second drive voltage generating path B2 is formed in a second DC/DC converter CONV2.

The discharge lamp lighting circuit 200 according to the second embodiment is described below. The description focuses on differences from the discharge lamp lighting circuit according to the first embodiment.

Figure 3:
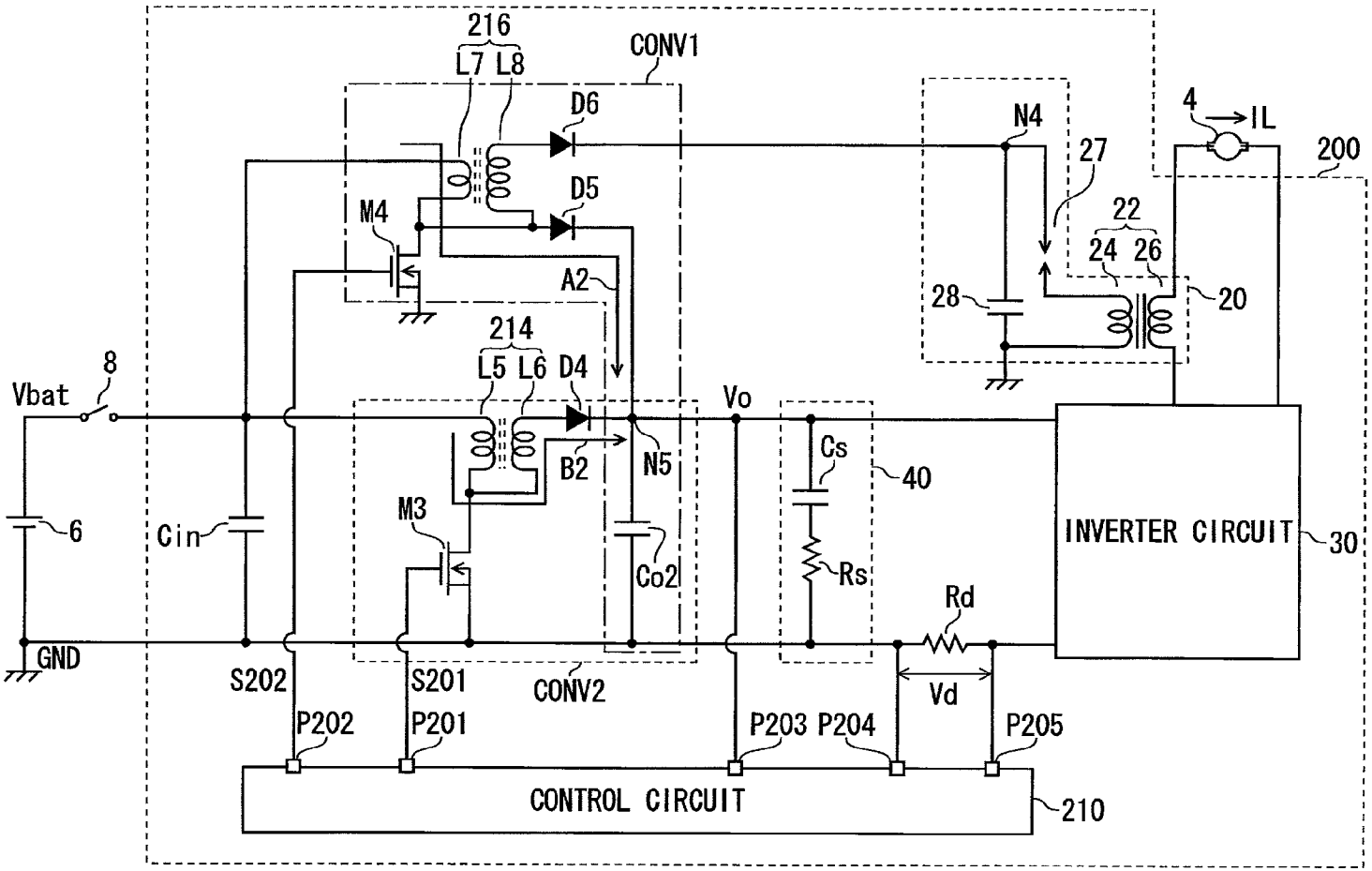
FIG. 3 is a circuit diagram showing the configuration of a discharge lamp lighting circuit according to a second embodiment.

FIG. 3 is a circuit diagram showing the configuration of a discharge lamp lighting circuit 200 according to the second embodiment. The discharge lamp lighting circuit 200 includes a control circuit 210, a starter circuit 20, an inverter circuit 30, an auxiliary lighting circuit 40, the first DC/DC converter CONV1, the second DC/DC converter CONV2, an input capacitor Cin, and a current detecting resistor Rd.

The second DC/DC converter CONV2 is a non-insulation type switching regulator and includes a second input transformer 214, a fourth output diode D4, a second output capacitor Co2, and a third switching element M3.

In the second input transformer 214, a primary winding L5 and the third switching element M3 are provided in parallel with the input capacitor Cin, and provided in series between an input terminal of the second DC/DC converter CONV2 and a ground terminal (GND). The third switching element M3 is composed of, for example, an N-channel MOSFET. One end of a secondary winding L6 in the second input transformer 214 is connected to a drain of the third switching element M3, and the other end thereof is connected to an anode of the fourth output diode D4. The second capacitor Co2 is provided between a cathode of the fourth output diode D4 and the ground terminal.

A control terminal (gate) of the third switching element M3 is connected to a first terminal P201 of the control circuit 210. In an active state of the second DC/DC converter CONV2, a first control pulse signal 5201 having a second drive frequency f2 and pulse-width modulated is applied to the control terminal of the third switching element M3.

The first DC/DC converter CONV1 is a non-insulation type switching regulator and includes a third input transformer 216, a fourth switching element M4, a fifth output diode D5, and a sixth output diode D6.

In the third input transformer 216, a primary winding L7 and a four switching element M4 are provided in parallel with the input capacitor Cin, and are provided in series between an input terminal of the first DC/DC converter CONV1 and a ground terminal (GND). The fourth switching element M4 is composed of, for example, an N-channel MOSFET. One end of a secondary winding L8 in the third input transformer 216 is connected to a drain of the fourth switching element M4. Further, one end of the secondary winding L8 in the third input transformer 216 is connected to an anode of the fifth output diode D5. The other end of the secondary winding L8 in the third input transformer 216 is connected to an anode of the sixth output diode D6.

The second output capacitor Co2 is provided between a cathode of the fifth output diode D5 and a ground terminal. Namely, the cathode of the fifth output diode D5 is connected to a fifth node N5 on a path connecting the cathode of the fourth output diode D4 and one end of the second output capacitor Co2. A cathode of the sixth output diode D6 is connected to a fourth connection node N4.

A control terminal (gate) of the fourth switching element M4 is connected to a second terminal P202 of the control circuit 210. In an active state of the first DC/DC converter CONV1, a second control pulse signal 5202 having a third drive frequency f3 and pulse-width modulated is applied to the control terminal of the fourth switching element M4.

The control circuit 210 includes the first terminal P201, the second terminal P202, a third terminal P203 to which an output voltage Vo generated as voltage between both ends of the second output capacitor Co2 is applied, a fourth terminal P204 connected to one end of the current detecting resistor Rd, and a fifth terminal P205 connected to the other end of the current detecting resistor Rd.

The control circuit obtains information of a lamp current IL210 on the basis of voltage drop Vd obtained from potential difference between the fourth terminal P204 and the fifth terminal P205. When the output voltage Vo is lower than a predetermined second threshold voltage V2 (for example, 200V), the control circuit 210 sends the first control pulse signal 5201 subjected to pulse-width modulation through the first terminal P201 to the third switching element M3. If the output voltage Vo is not so, the control circuit 210 holds the first control pulse signal S201 at a low level, and puts the second DC/DC converter CONV2 in a non-active state. The control circuit 210, when the output voltage Vo is higher than a predetermined third threshold voltage V3 (for example, 150V), sends the second control pulse signal 5202 subjected to pulse-width modulation through the second terminal P202 to the fourth switching element M4. If the output voltage Vo is not so, the control circuit 210 holds the second control pulse signal S202 at the low level, and puts the first DC/DC converter CONV2 in the non-active state.

A circuit constant of the first DC/DC converter CONV1, a circuit constant of the second DC/DC converter CONV2, a duty ratio of the first control pulse signal 5201, and a duty ratio of the second control pulse signal 5202 are established so that when the first DC/DC converter CONV1 is in the active state, the output voltage Vo becomes higher than the output voltage Vo if the converter CONV1 is not so. In particular, they are configured so that a maximum value of the output voltage Vo when the first DC/DC converter CONV1 is in the active state is set to about 400V, and a maximum value of the output voltage Vo when the second DC/DC converter CONV2 is in the active state is set to about 200V.

Considering a voltage stepping-up path, the discharge lamp lighting circuit 200 is provided with the first drive voltage generating path A2 having one end to which battery voltage Vbat is applied and the other end as which the second output capacitor Co2 serves, and the second drive voltage generating path B2 having one end to which the battery voltage Vbat is applied and the other end as which the second output capacitor Co2 serves. The second drive voltage generating path B2 is different from the first drive voltage generating path A2. The first drive voltage generating path A2 is formed in the first DC/DC converter CONV1, and includes the primary winding L7 of the third input transformer 216, the fifth output diode D5, and the second output capacitor Co2. The second drive voltage generating path B2 is formed in the second DC/DC converter CONV2, and includes the primary winding L5 and the secondary winding L6 of the second input transformer 214, the fourth output diode D4, and the second output capacitor Co2.

Figure 4:
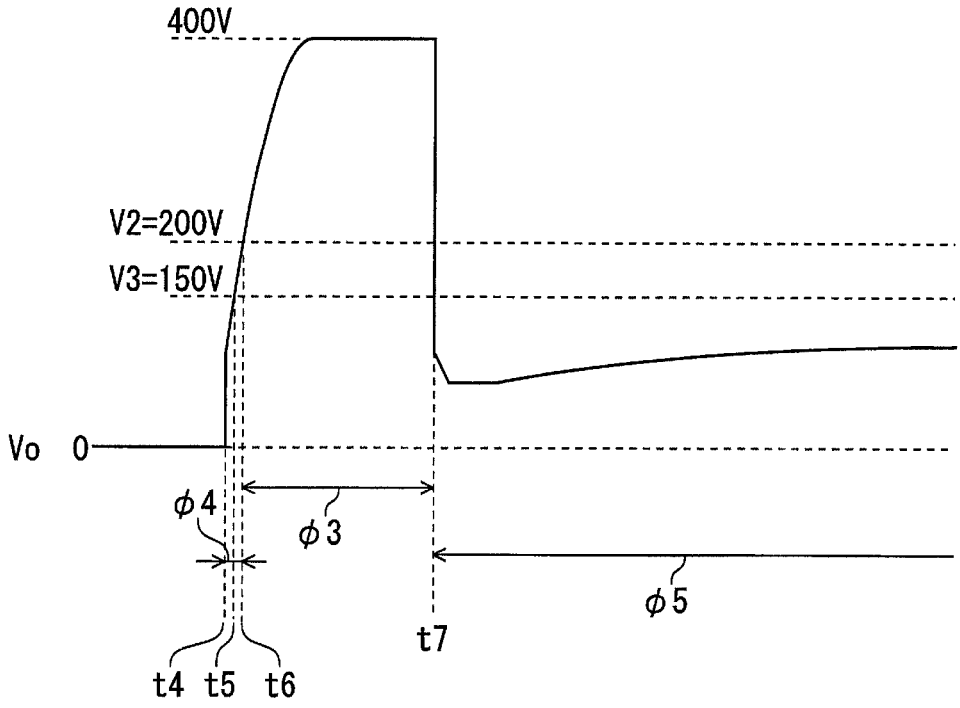
FIG. 4 is a time chart showing a time change of the output voltage.

Next, operation of the discharge lamp lighting circuit 200 is described. FIG. 4 is a time chart showing a time change of the output voltage Vo. The ordinate axis and the abscissa axis in FIG. 4 are enlarged or reduced to facilitate understanding, and each waveform illustrated therein is also simplified to facilitate understanding.

At time t4, when a user turns on the power switch 8, the discharge lamp lighting circuit 200 starts up. Since the output voltage Vo is smaller than the second threshold voltage V2 at the start time, the control circuit 210 puts the second DC/DC converter CONV2 in the active state. Then, electric charge is stored in the second output capacitor Co2 and together the output voltage Vo increases.

At time t5, when the output voltage Vo comes to the third threshold voltage V3, the control circuit 210 puts the first DC/DC converter CONV1 in the active state. At time t6 when the output voltage Vo comes to the second threshold voltage V2, the control circuit 210 puts the second DC/DC converter CONV2 in the non-active state. During a period from the time t5 to the time t6, both the first DC/DC converter CONV1 and the second DC/DC converter CONV2 are in the active state.

At time t7, by the starter circuit 20, a high-voltage pulse is applied to the discharge lamp 4. As a result, electric breakdown occurs in the discharge lamp 4 and glow discharge is started. Namely, the discharge lamp 4 starts lighting up. When the discharge lamp 4 starts lighting up, the output voltage Vo is stabilized at the voltage which is lower than the third threshold voltage V3. When the output voltage Vo decreases from about 400V to the voltage lower than the third threshold voltage, there is a period during which both the first DC/DC converter CONV1 and the second DC/DC converter CONV2 are in the active state such as the period from the time t5 to the time t6, which is not shown in FIG. 4

The first DC/DC converter CONV1 is in the active state during a period ϕ3 from time 5 to time 7. The second DC/DC converter CONV2 is in the active state during a period ϕ4 from time t4 to time t6 and during a period ϕ5 from time 7.

The discharge lamp lighting circuit 200 according to the embodiment includes the first drive voltage generating path A2 which generates the high output voltage Vo required before lighting, and the second drive voltage generating path B2 which generates the low output voltage Vo at the stationary lighting time. Further, both paths use the second output capacitor Co2 as one end in common. Therefore, the discharge lamp lighting circuit 200 has operational advantages similar to those in the discharge lamp lighting circuit 100 according to the first embodiment. Further, so that there is provided the period during which both the first DC/DC converter CONV1 and the second DC/DC converter CONV2 are put in the active state at the switching time between the first DC/DC converter CONV1 and the second DC/DC converter CONV2, and particularly in the breakdown time, a relation in voltage level between the second threshold voltage V2 and the third threshold voltage V3 is set. Accordingly, switching of the path can be performed smoothly.

The configuration and the operation of the discharge lamp lighting circuits according to the first and second embodiments have been described above. These embodiments are illustrative and it is to be understood by a person of ordinary skill in the art that various modifications can be made in a combination of each component and each processing and such the modifications are also included as part of the disclosure. Further, combination of the embodiments also can be made.

In the second embodiment, although the situation where the active state/non-active state of the DC/DC converter is controlled by the output voltage Vo has been described, the disclosure is not limited to this case. For example, the state of the DC/DC converter may be controlled on the basis of the lamp current IL.

In the first embodiment, although the second drive voltage generating path B portion adopts a flyback type circuit, the disclosure is not limited to this. For example, a boost chopper type circuit may be adopted. In the second embodiment, although the second DC/DC converter CONV2 adopts a flyback type circuit, the disclosure is not limited to this. For example, a forward circuit or a boost chopper type circuit may be adopted.

In the first and second embodiments, though the case where the discharge lamp 4 is driven with the AC voltage has been described, the disclosure is not limited to this case. For example, the technical idea in the embodiments may be applied to a discharge lamp lighting circuit in which the discharge lamp 4 is driven with the DC voltage. In this case, the configuration in which the inverter circuit 30 is removed from the embodiments may be used.

In the first and second embodiments, though the case where the non-insulation type DC/DC converter is used has been described, the disclosure is not limited to this case. For example, an insulation-type DC/DC converter may be used.

In the first and second embodiments, though the discharge lamp 4 and the discharge lamp lighting circuit have been described as different bodies, the disclosure is not limited to this. For example, the discharge lamp may be incorporated into the discharge lamp lighting circuit.

In the first and second embodiments, though the case where the discharge lamp lighting circuit supplies the electric power to the discharge lamp 4 has been described, the disclosure is not limited to this case. For example, the technical idea in the embodiments may be applied also to a lighting circuit which supplies the electric power to a semi-conductor light source such as LED (Light Emitting Diode).

In the first embodiment, the first drive voltage generating path A may include a first current-limiting resistor R1 not included in the second drive voltage generating path B. For example, the first current-limiting resistor R1 may be provided between the second connection node N2 and one end of the third coil L3, or between the other end of the third coil L3 and the anode of the second output diode D2, or between the cathode of the second output diode D2 and the drain of the second switching element M2, or between the source of the second switching element M2 and one end of the first output capacitor Co1. Alternatively, at plural places arbitrarily selected from their places, the first current-limiting resistors may be provided. Further, in place of the resistor, another element for limiting the current may be used.

The path which supplies the power for keeping the discharge lamp 4 lighting is the second drive voltage generating path B. Accordingly, the DC resistance component of this path should be as small as possible so that a thick winding of the coil, a thick wiring pattern thereof, and the first output diode D1 having a large rating current are used. On the other hand, the first drive voltage generating path A supplies the power only for tens msec since the discharge lamp lighting circuit 100 starts up till the discharge lamp lights up. Therefore, in order to miniaturize the discharge lamp lighting circuit 100, it is desirable that winding and a wiring pattern of the third coil L3 are as thin as possible and the second output diode D2 is also small. However, in the discharge lamp lighting circuit 100 shown in FIG. 1, while the first drive voltage generating path A is in the ON-state, the comparatively large current can flow to the first output capacitor Co1 till full charging is completed.

Therefore, by proving the first current-limiting resistor as described above, it is possible to limit a peak value of the charging current for the first output capacitor Co1. Hereby, the winding and the wiring pattern of the third coil L3 can be made thin, and the small and inexpensive second output diode D2 can be used. In case that a printed resistor is used as the first current-limiting resistor, since a resistor element itself has hardly an increase in cost, the printed resistor is particularly available.

Further, the similar current limit also can be applied to the charging path including the fourth coil L4, the third output diode D3 and the starter capacitor 28. Namely, this charging path may include a second current-limiting resistor R2. For example, the second current-limiting resistor R2 may be provided between the third connection node N3 and one end of the fourth coil L4, or between the other end of the fourth coil L4 and the anode of the third output diode D3, or between the cathode of the third output diode D3 and the other end of the starter capacitor 28, or between one end of the starter capacitor 28 and the ground voltage.

In the first embodiment, although the case where one end of third coil L, that is, a low-voltage end is connected to the other end of the second coil L2 has described, the disclosure is not limited to this case. For example, the battery voltage Vbat may be applied to one end of the third coil L3, or one end of the third coil L3 may be grounded.

Figure 5:
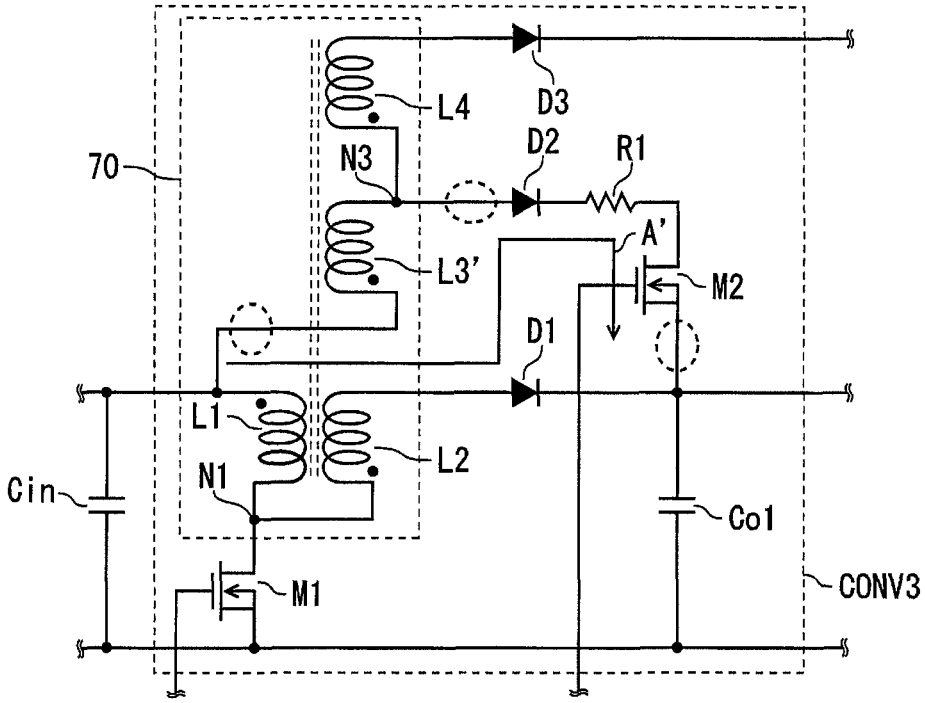
FIG. 5 is a circuit diagram showing the configuration of a third DC/DC converter in a modified example in which the battery voltage is applied to one end of a third coil.

FIG. 5 is a circuit diagram showing the configuration of a third DC/DC converter CONV3 in a modified example in which the battery voltage Vbat is applied to one end of a third coil L3'. One end of the third coil L3' is connected to one end of a first coil L1. In this case, a first drive voltage generating path A' includes the third coil L3', a second output diode D2, a first current-limiting resistor R1, a second switching element M2, and a first output capacitor Co1. A circle shown by a dashed line in FIG. 5 shows an alternative position where the first current-limiting resistor R1 may be provided.

Figure 6:
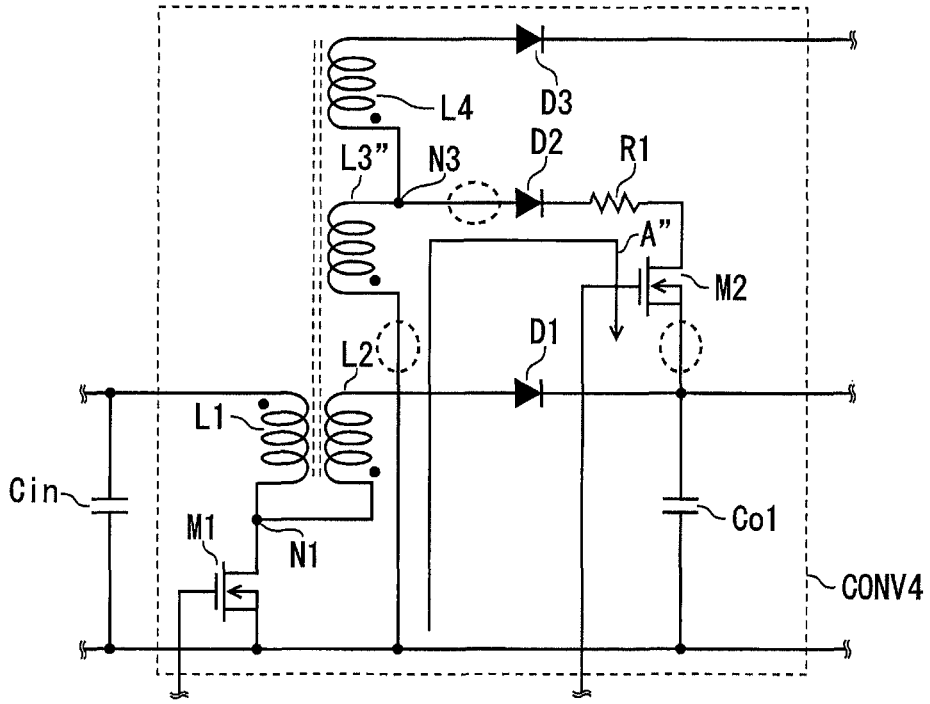
FIG. 6 is a circuit diagram showing the configuration of a fourth DC/DC converter in a modified example in which one end of a third coil is grounded.

FIG. 6 is a circuit diagram showing the configuration of a fourth DC/DC converter CONV4 in a modified example in which one end of a third coil L3" is grounded. One end of the third coil L3" is connected to a ground terminal (not shown in FIG. 6). In this case, a first drive voltage generating path A" includes the third coil L3", a second output diode D2, a first current-limiting resistor R1, a second switching element M2, and a first output capacitor Co1. A circle shown by a dashed line in FIG. 6 shows an alternative position where the first current-limiting resistor R1 may be provided.

In case that one end of the third coil L3 is connected to the other end of the second coil L2, the voltage of the third connection node N3 becomes the sum of the voltage induced by the second coil L2 and the voltage induced by the third coil L3. Accordingly, when the voltage required for the third connection node N3 has been determined, the number of turns in the third coil L3 can be reduced compared with that in the modified examples shown in FIG. 5 and FIG. 6.

Further, depending on application or design of the transformer, the configurations in the modified examples shown in FIGS. 5 and 6 are also permitted. In this case, the number of turns in the third coil L3' or L3" connected magnetically to the first coil L1 is increased.

Third Embodiment

Figure 7:
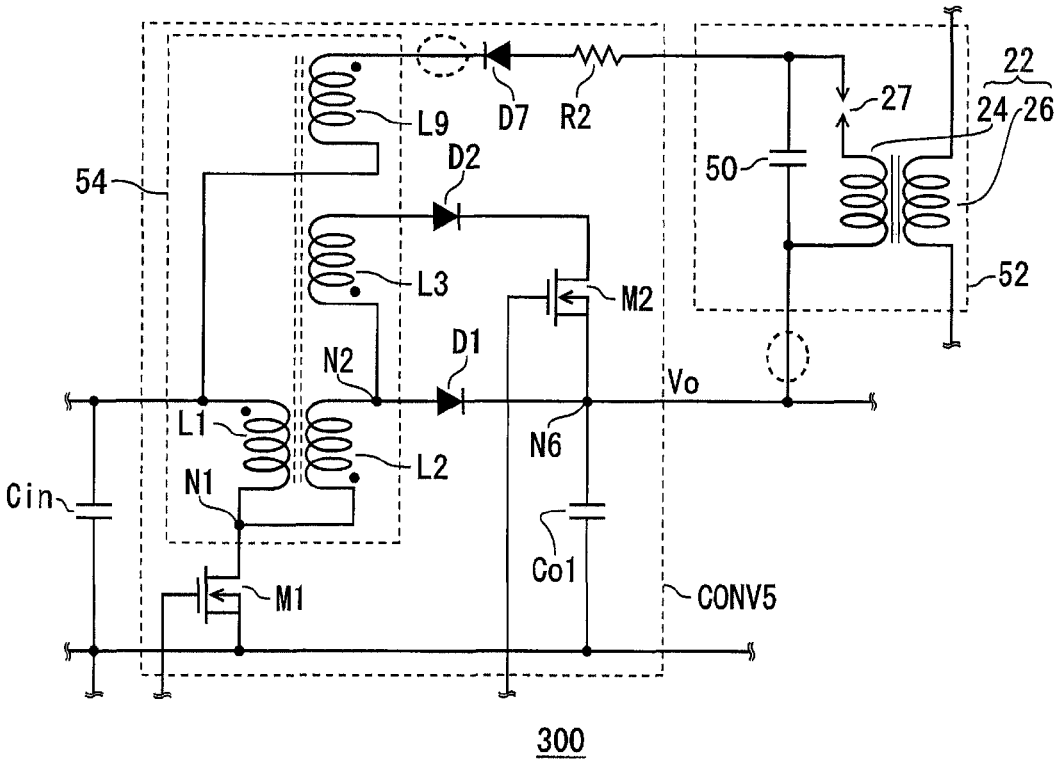
FIG. 7 is a circuit diagram showing the configuration of a discharge lamp lighting circuit according to a third embodiment.

FIG. 7 is a circuit diagram showing the configuration of a discharge lamp lighting circuit 300 according to a third embodiment. The discharge lamp lighting circuit 300 includes a control circuit 10, a first starter circuit 52, an inverter circuit 30, an auxiliary lighting circuit 40, a fifth DC/DC converter CONV5, an input capacitor Cin, and a current detecting resistor Rd. In FIG. 7, in order to facilitate understanding of description more, only the fifth DC/DC converter CONV5, input capacitor Cin, and first starter circuit 52 are shown and illustration of other members is omitted.

The fifth DC/DC converter CONY 5 includes a first coil L1, a second coil L2, a third coil L3, a ninth coil L9 corresponding to the fourth coil L4, a first switching element M1, a second switching element M2, a first output diode D1, a second output diode D2, a seventh output diode D7 corresponding to the third output diode D3, and a first output capacitor Co1. The first starter circuit 52 includes a high-voltage transformer 22, a spark gap 27, a first starter capacitor 50 corresponding to the starter capacitor 28.

Main differences between the discharge lamp lighting circuit 300 in the third embodiment and the discharge lamp lighting circuit 100 in the first embodiment are that:

(1) The direction of anode/cathode of the third output diode D3 is opposite to the direction of anode/cathode of the seventh output diode D7 corresponding to the third output diode D3.

(2) One end of the first starter capacitor 50 is connected to an anode of the seventh output diode D7, and the other end thereof is not grounded but connected to a node N6 on a path connecting a cathode of the first output diode D1 and one end of the first output capacitor Co1.

(3) The direction of winding of the fourth coil L4 is opposite to the direction of winding of the ninth coil L9 corresponding to the fourth coil L4; and one end of the ninth coil L9 is connected to a cathode of the seventh output diode D7, and the other end thereof is connected to one end of the first coil L1.

According to the foregoing differences (1) and (3), a series circuit having the ninth coil L9 connected magnetically to the first coil L1 and the seventh output diode D7 connected in series to its ninth coil L9 applies a negative voltage to one end of the first capacitor 50. According to the different point (2), to the other end of the first starter capacitor 50, a positive output voltage Vo is applied in principle. Therefore, a maximum absolute value of the voltage to be applied to one end of the first starter capacitor 50 is equal to a value obtained by subtracting the output voltage Vo from an absolute value of the voltage between terminals of the first starter capacitor 50 required to make the spark gap 27 conduct, and becomes lower than the absolute value of the voltage between the terminals of the first starter capacitor 50. For example, taking the voltage between the terminals of the first starter capacitor 50 required to make the spark gap 27 conduct as 1000V, and the output voltage Vo as 400V, when the voltage applied to one end of the first starter capacitor 50 comes to −600V, the spark gap 27 conducts. The seventh output diode D7 which is lower in withstand voltage can be used, and also isolation voltage between the wiring pattern and other wiring or a case can be decreased more. Therefore, the discharge lamp lighting circuit 300 can be reduced in size and manufactured inexpensively.

Regarding the first input transformer 14 in the first embodiment, the total number of terminals in the first input transformer 14 is five terminals of connection to the battery voltage Vbat, connection to the drain of the first switching element M1, connection to the anode of the first output diode D1, connection to the anode of the second output diode D2, and connection to the anode of the third output diode D3. Also in the third embodiment, the first coil L1, the second coil L2, the third coil L3, and the ninth coil L9 constitute one input transformer 54. Of terminals of this input transformer 54, an input voltage terminal to which the battery voltage Vbat is to be applied is connected, inside the input transformer 54, to one end of the first coil L1 and the other end of the ninth coil.

Considering a connecting destination of the other end of the ninth coil, since one end thereof generates the negative voltage, it is desirable that the other end is connected to the node which is as low in voltage as possible. This is because the number of turns in the ninth coil L9 can be reduced. Although the lowest voltage which is available is a ground voltage, in case of connection to the ground, a terminal for bringing the ground voltage in the input transformer is required, with the result that the number of terminals in the input transformer increases to 6 terminals. In this case, compared with the case in the first embodiment, increases in size of the input transformer and in cost are obtained. Therefore, as shown in FIG. 7, the other end of the ninth coil is connected to one end of the first coil L1 where the voltage is lowest next to the ground voltage, whereby the input transformer can be constituted by the five terminals similarly to in the first embodiment. In this case, the battery voltage Vbat applied to the other end of the ninth coil is 10V to 20V in many cases, so that an influence by difference between this voltage Vbat and the ground voltage (=0V) is comparatively small. On that basis, it is possible to suppress an increase in the number of terminals in the input transformer.

In particular, surface-mounting the discharge lamp lighting circuit according the first or the third embodiment on a ceramic substrate, to enable an increase in the number of terminals in the input transformer to be suppressed, can be advantageous in the following ways.

(1) The space on the ceramic substrate for terminals of a surface-mounting transformer is comparatively large. Accordingly, by preventing the increase in the number of terminals, the size of the ceramic substrate can be held small, or more other elements and wirings can be provided on the ceramic substrate.

(2) In the surface-mounting on the ceramic substrate, the terminal is fixed to the substrate by welding. By preventing the increase in the number of terminals, an increase in margin area set around the terminal for welding can be suppressed.

(3) It is difficult to weld the plural terminals at one time, which is different from the case of reflow-type soldering. Therefore, by preventing the increase in the number of terminals, an increase in number of operation steps can be suppressed.

(4) Increases in size and cost of the input transformer can be prevented.

Further, the current limit described in connection with the first current-limiting resistor R1 can be applied to a charging path including the ninth coil L9, the seventh output diode D7 and the first starter capacitor 50. Namely, this charging path may include a second current-limiting resistor R2. For example, the second current-limiting resistor R2 may be provided between one end of the ninth coil L9 and the cathode of the seventh output diode D7, or between the anode of the seventh output diode D7 and one end of the first starter capacitor 50, or between the other end of the first starter capacitor 50 and one end of the first output capacitor Co1. A circle shown by a dashed line in FIG. 7 shows an alternative position where the second current-limiting resistor R2 may be provided.

Further, though the second current-limiting resistor R2 may be provided also between one end of the first coil L1 and the other end of the ninth coil L9 from an electrical viewpoint, the number of terminals of the input transformer can increase in this case.

Fourth Embodiment

Figure 8:
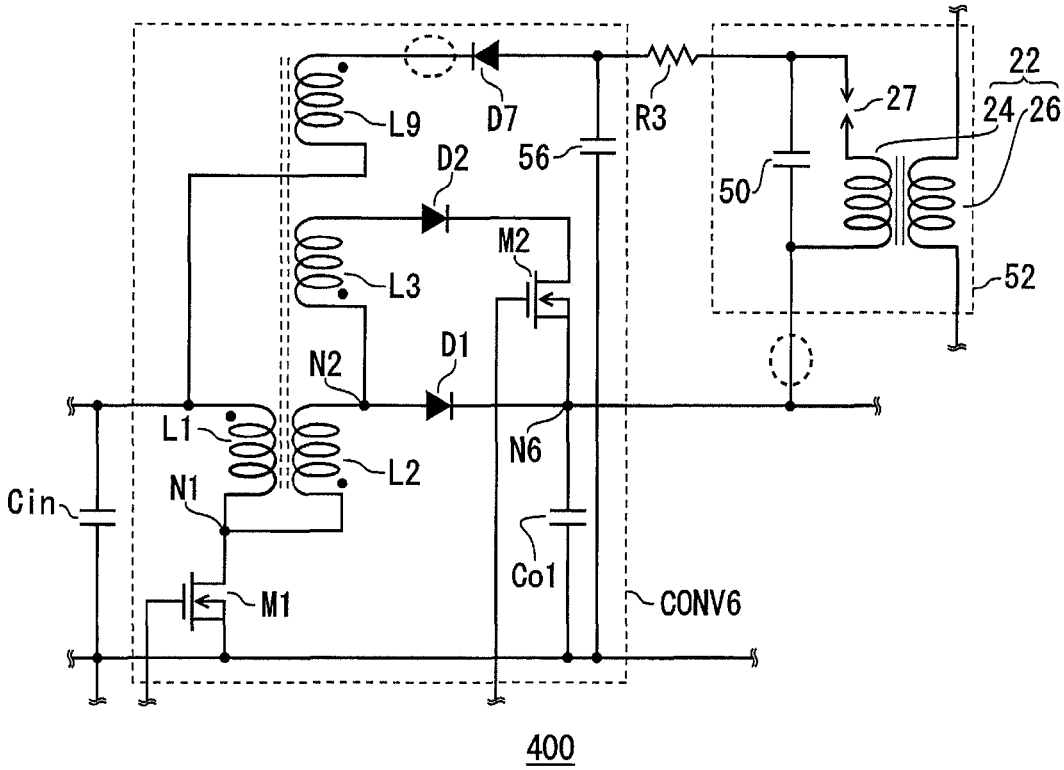
FIG. 8 is a circuit diagram showing the configuration of a discharge lamp lighting circuit according to a fourth embodiment.

FIG. 8 is a circuit diagram showing the configuration of a discharge lamp lighting circuit 400 according to a fourth embodiment. The discharge lamp lighting circuit 400 includes a control circuit 10, a first starter circuit 52, an inverter circuit 30, an auxiliary lighting circuit 40, a sixth DC/DC converter CONV6, an input capacitor Cin, a current detecting resistor Rd, and a third current-limiting resistor R3. In FIG. 8, in order to facilitate understanding of description more, only the sixth DC/DC converter CONV6, third current-limiting resistor R3, input capacitor Cin, and first starter circuit 52 are shown and illustration of other members is omitted.

The sixth DC/DC converter CONY 6 includes a first coil L1, a second coil L2, a third coil L3, a ninth coil L9 corresponding to the fourth coil L4, a first switching element M1, a second switching element M2, a first output diode D1, a second output diode D2, a seventh output diode D7 corresponding to the third output diode D3, a first output capacitor Co1, and an auxiliary charging capacitor 56. One end of the auxiliary charging capacitor 56 is connected to an anode of the seventh output diode D7, and the other end thereof is grounded. One end of the third current-limiting resistor R3 is connected to the anode of the seventh output diode D7, and the other thereof is connected to one end of the first starter capacitor 50.

In the discharge lamp lighting circuit 400, the output of the seventh output diode D7 is rectified once by the auxiliary charging capacitor 56 which is small in capacity. The capacity of the auxiliary charging capacitor 56 is smaller than that of the first starter capacitor 50. For example, when the capacity of the first starter capacitor 50 is taken as 0.1 μF, the capacity of the auxiliary charging capacitor 56 is about 100 pF to 1000 pF. Therefore, the time necessary to charge the auxiliary charging capacitor 56 is shorter than the time necessary to charge the first starter capacitor 50.

Since the capacity of the auxiliary charging capacitor 56 is small, a peak value of the current flowing into the seventh output diode D7 and the ninth coil L9 is low. While the charging current from the auxiliary charging capacitor 56 is being limited by the third current-limiting resistor R3 having a resistance value of about 100 kΩ, the first stator capacitor 50 is charged with the limited current. In this case, though the number of capacitors increases compared with that in the first embodiment, since the voltage to be used in charging is smoothed before charging of the first starter capacitor 50, the charging time can be stabilized. For example, against change of the element with the passage of time, and fluctuation of the battery voltage, the charging time can be stabilized. The third current-limiting resistance R3 may be provided between the other end of the first starter capacitor 50 and one end of the first output capacitor Co1. A circle shown by a dashed line in FIG. 8 shows an alternative position where the third current-limiting resistor R3 may be provided.

In the modified example shown in FIG. 5, the first coil L1, the second coil L2, the third coil L3', and the fourth coil L4 constitute one input transformer 70. Of terminals of this input transformer 70, an input voltage terminal to which the battery voltage Vbat is to be applied is connected, inside the input transformer 70, to one end of the first coil L1 and one end of the third coil L3'.

Although the invention has been described with respect to the foregoing embodiments, those skilled in the art, having benefit of this disclosure, will appreciate that other embodiments can be devised which do not depart from the scope of the invention as disclosed herein. Accordingly, other implementations are within the scope of the claims.

What is claimed is:

1. A discharge lamp lighting circuit comprising:

a first DC/DC converter configured to generate from an input voltage a drive voltage to be applied to a discharge lamp of a driven object;

a first drive voltage generating path which has one end to which the input voltage is applied, and at the other end of which is an output capacitor on an output side of the DC/DC converter;

a second drive voltage generating path which has one end to which the input voltage is applied, and at the other end of which is the output capacitor, and which is different from the first drive voltage generating path; and a control circuit configured to control ON/OFF of the first drive voltage generating path, wherein said discharge lamp lighting circuit is arranged so that the voltage of the output capacitor when the first drive voltage generating path is in an ON-state becomes higher than the voltage of the output capacitor when the first drive voltage generating path is not ON-state.

2. The discharge lamp lighting circuit according to claim 1, wherein the control circuit is configured to cause the first drive voltage generating path to be in an OFF-state when the discharge lamp lights up.

3. The discharge lamp lighting circuit according to claim 2, wherein the control circuit is configured to provide, before causing the first drive voltage generating path to be in the OFF-state, a period during which both the first drive voltage generating path and the second drive voltage generating path are in the ON-state.

4. The discharge lamp lighting circuit according to claim 1, wherein the DC/DC converter comprises:

an input coil having one end to which the input voltage is applied, a switching element configured to provide electric conduction between the other end of the input coil and a constant-voltage terminal, a first diode provided between a node on a path connecting the other end of the input coil and the switching element, and the output capacitor, and a series circuit which is a provided between the node on the path connecting the other end of the input coil and the switching element, and the output capacitor, and is provided in parallel with the first diode;

wherein the series circuit has a second diode and another switching element which are connected in series;

the control circuit is configured to send a pulse-width modulated signal to the switching element;

the first drive voltage generating path includes the input coil, the series circuit, and the output capacitor;

the second drive voltage generating path includes the input coil, the first diode, and the output capacitor; and the control circuit is configured to turn on another switching element to cause the first drive voltage generating path to be in the ON-state.

5. The discharge lamp lighting circuit according to claim 1 including a second DC/DC converter having the output capacitor in common with the first DC/DC converter;

wherein the second drive voltage generating path is formed in the first DC/DC converter; and the first drive voltage generating path is formed in the second DC/DC converter.

6. The discharge lamp lighting circuit according to claim 1, wherein the DC/DC converter comprises:

an input coil having one end to which the input voltage is applied, a switching element configured to provide electric conduction between the other end of the input coil and a constant-voltage terminal, a first diode provided between a node on a path connecting the other end of the input coil and the switching element, and the output capacitor, and a series circuit which has one end to which the output capacitor is connected, and which is provided in parallel with the first diode;

wherein the series circuit has a second diode and another switching element which are connected in series;

the control circuit is configured to send a pulse-width modulated signal to the switching element;

the first drive voltage generating path includes the series circuit and the output capacitor;

the second drive voltage generating path includes the input coil, the first diode, and the output capacitor; and the control circuit is configured to turn on another switching element thereby to cause the first drive voltage generating path to be in the ON-state.

7. The discharge lamp lighting circuit according to claim 1 including a starter circuit configured to generate a high-voltage pulse in order to cause electric breakdown in the discharge lamp;

wherein the DC/DC converter comprises:

an input coil having one end to which the input voltage is applied, a switching element configured to provide electric conduction between the other end of the input coil and a constant-voltage terminal, a first diode provided between a node on a path connecting the other end of the input coil and the switching element, and the output capacitor, and a series circuit which has an output coil connected magnetically to the input coil, and a second diode connected to the output coil in series; and the control circuit is configured to send a pulse-width modulated signal to the switching element;

wherein the starter circuit comprises:

a high-voltage transformer of which a secondary winding is connected to the discharge lamp, and a starter capacitor which has one end connected to a node on a path connecting the first diode and the output capacitor, and is charged up to the voltage to be applied to a primary winding of the high-voltage transformer; and wherein the series circuit is configured to apply, to the other end of the starter capacitor, the voltage having an opposite polarity to a polarity of the voltage at the node on the path connecting the first diode and the output capacitor.

8. The discharge lamp lighting circuit according to claim 6 wherein:

the input coil constitutes at least a part of one input transformer; and a terminal of the input transformer which is connected to one end of the input coil and to which the input voltage is applied is connected to the series circuit.

9. The discharge lamp lighting circuit according to claim 7 wherein:

the input coil constitutes at least a part of one input transformer; and a terminal of the input transformer which is connected to one end of the input coil and to which the input voltage is applied is connected to the series circuit.

* * * * *